US012703993B2

(12) United States Patent
Yuan et al.

(10) Patent No.: US 12,703,993 B2
(45) Date of Patent: Aug. 11, 2026

(54) COLLAPSIBLE CANOPY

(71) Applicant: ZHEJIANG HUIGUAN LEISURE PRODUCTS CO., LTD., Liyang Town (CN)

(72) Inventors: Chunliang Yuan, Liyang Town (CN); Shengyong Yang, Liyang Town (CN)

(73) Assignee: ZHEJIANG HUIGUAN LEISURE PRODUCTS CO., LTD., Zhejiang (CN)

( * ) Notice: Subject to any disclaimer, the term of this patent is extended or adjusted under 35 U.S.C. 154(b) by 727 days.

(21) Appl. No.: 18/008,821

(22) PCT Filed: Jun. 10, 2021

(86) PCT No.: PCT/CN2021/099395
§ 371 (c)(1),
(2) Date: Dec. 7, 2022

(87) PCT Pub. No.: WO2021/249483
PCT Pub. Date: Dec. 16, 2021

(65) Prior Publication Data

US 2023/0220699 A1 Jul. 13, 2023

(30) Foreign Application Priority Data

Jun. 12, 2020 (CN) ..... 202021090731.7

(51) Int. Cl.
*E04H 15/50* (2006.01)
*E04H 15/46* (2006.01)

(52) U.S. Cl.
CPC ..... *E04H 15/50* (2013.01); *E04H 15/46* (2013.01)

(58) Field of Classification Search
CPC ..... E04H 15/50
See application file for complete search history.

(56) References Cited

U.S. PATENT DOCUMENTS 5,230,358 A * 7/1993 Forell ..... E04H 15/322 135/133
5,490,532 A * 2/1996 Mallookis ..... E04H 15/50 52/109

(Continued)

FOREIGN PATENT DOCUMENTS

CN 203835032 U 9/2014
CN 204024196 U 12/2014

(Continued)

OTHER PUBLICATIONS

International Search Report for PCT/CN2021/099395, mailed on.

*Primary Examiner* — David R Dunn
*Assistant Examiner* — Danielle Jackson
(74) *Attorney, Agent, or Firm* — Schmeiser Olsen PLLC

(57) ABSTRACT

A collapsible canopy is provided, including a central lock, peripheral assembly, and a plurality of inner retractable units connected between the central lock and the peripheral assembly. Each inner retractable unit includes a first top rod and a second top rod hinged to each other. The central lock includes: a central rod; a bottom cap, provided on the lower portion of the central rod and hinged to the second top rod; a top cap, sleeved on the central rod and hinged to the first top rod; a locking mechanism provided between the top cap and the central rod, with a locked state and an unlocked state; and an operation part for locking and/or unlocking the locking mechanism, located at the bottom of the central lock. The structure of the locking mechanism is simplified and conveniently performed at the bottom of the central lock.

10 Claims, 20 Drawing Sheets

(56) References Cited

U.S. PATENT DOCUMENTS

| | | | | |
|---|---|---|---|---|
| 6,708,707 | B2 * | 3/2004 | Dotterweich | E04H 15/50 135/159 |
| 7,240,686 | B2 * | 7/2007 | Seo | E04H 15/50 135/159 |
| 7,422,026 | B2 * | 9/2008 | Kim | E04H 15/50 135/120.2 |
| 9,995,056 | B2 * | 6/2018 | Yang | E04H 15/50 |
| 10,060,153 | B2 * | 8/2018 | Song | E04H 15/34 |
| 10,107,005 | B2 * | 10/2018 | Song | E04H 15/44 |
| 10,246,898 | B2 * | 4/2019 | Jin | E04H 15/46 |
| 10,273,710 | B2 * | 4/2019 | Yang | E05B 65/00 |
| 10,273,711 | B2 * | 4/2019 | Song | E04H 15/48 |
| 10,487,530 | B1 * | 11/2019 | Jun | E04H 15/322 |
| 10,669,738 | B2 * | 6/2020 | Yang | E04H 15/50 |
| 10,822,829 | B1 * | 11/2020 | Lu | E04H 15/32 |
| 10,941,585 | B2 * | 3/2021 | Sun | E04H 15/50 |
| 11,002,036 | B1 * | 5/2021 | Zhang | E04H 15/48 |
| 11,085,201 | B2 * | 8/2021 | Sun | E04H 15/50 |
| 11,306,502 | B2 * | 4/2022 | Chen | E04H 15/50 |
| 11,821,228 | B2 * | 11/2023 | Sun | E04H 15/60 |
| 11,988,007 | B2 * | 5/2024 | Liu | E04H 15/32 |
| 12,084,878 | B2 * | 9/2024 | Zhou | E04H 15/48 |
| 12,264,492 | B2 * | 4/2025 | Qiu | E04H 15/48 |
| 12,270,218 | B2 * | 4/2025 | Qiu | E04H 15/18 |
| 12,312,826 | B1 * | 5/2025 | Gong | E04H 15/48 |
| 12,467,283 | B2 * | 11/2025 | Zhang | E05B 65/00 |
| 2002/0074032 | A1 * | 6/2002 | Park | E04H 15/50 135/131 |
| 2015/0247339 | A1 * | 9/2015 | Lee | E04H 15/50 135/145 |
| 2015/0308147 | A1 * | 10/2015 | Lee | E04H 15/60 135/145 |
| 2016/0168874 | A1 | 6/2016 | Lovley, II | |
| 2019/0234101 | A1 * | 8/2019 | Lu | E04H 15/18 |
| 2019/0234102 | A1 * | 8/2019 | Lu | E04H 15/50 |
| 2019/0368232 | A1 * | 12/2019 | Sun | E04H 15/50 |
| 2020/0181938 | A1 * | 6/2020 | Xu | E04H 15/50 |
| 2020/0181939 | A1 * | 6/2020 | Ying | E04H 15/34 |
| 2020/0240168 | A1 * | 7/2020 | Sun | E04H 15/50 |
| 2021/0238880 | A1 * | 8/2021 | Qiu | E04H 15/32 |
| 2022/0412117 | A1 * | 12/2022 | Yan | E04H 15/64 |
| 2024/0011319 | A1 * | 1/2024 | Yan | E04H 15/54 |
| 2024/0068267 | A1 * | 2/2024 | Yang | E04H 15/50 |
| 2024/0376743 | A1 * | 11/2024 | Wang | E04H 15/48 |

FOREIGN PATENT DOCUMENTS

| | | | |
|---|---|---|---|
| CN | 104265063 | A | 1/2015 |
| CN | 204782240 | U | 11/2015 |
| CN | 207245328 | U | 4/2018 |
| CN | 108026736 | A | 5/2018 |
| CN | 209324125 | U | 8/2019 |
| CN | 210152397 | U | 3/2020 |

* cited by examiner

A–A

COLLAPSIBLE CANOPY

CROSS-REFERENCE TO RELATED APPLICATIONS

This application claims priority to PCT Application No. PCT/CN2021/099395, having a filing date of Jun. 10, 2021, which claims priority to CN application No. 202021090731.7, having a filing date of Jun. 12, 2020, the entire contents both of which are hereby incorporated by reference.

FIELD OF TECHNOLOGY

The following relates to a collapsible canopy.

BACKGROUND

The traditional canopy is provided with a lock catch on its leg rods, and the retraction requires the cooperation of several people, and the operation is extremely complicated. Chinese Patent Application No. 201680023809.3 discloses a central lock and a canopy. A central rod in the central lock and a top cap are fixedly connected, and the locking mechanism is arranged between the central rod and a bottom cap. There are many components and the structure is relatively complicated. In addition, in order to coordinate with the unfolding and folding of the canopy, the central rod must be designed to be a fixed length.

SUMMARY

An aspect relates to providing a collapsible canopy.

To achieve the above purpose, a technical solution employed by the present disclosure is: A collapsible canopy is provided with an unfold state and a folded state, and comprises a central lock, a peripheral assembly, and a plurality of inner retractable units connected between the central lock and the peripheral assembly, and each inner retractable unit comprises a first top rod and a second top rod hinged to each other. The central lock comprises:

a bottom cap, hinged with the second top rod;

a central rod, wherein the lower portion of the central rod is connected to the bottom cap;

a top cap, arranged above the bottom cap, and hinged with the first top rod;

a locking mechanism, the locking mechanism is arranged between the top cap and the central rod; and the locking mechanism is provided with a locked state and an unlocked state, the central lock comprises an operation part for a user to operate to lock and/or unlock the locking mechanism, the operation part is located at the bottom of the central lock;

if the locking mechanism is in the locked state, a relative position between the top cap and the central rod is fixed;

if the locking mechanism is in the unlocked state, the fixed relative position between the top cap and the central rod can be released.

As an optional technical solution, when the locking mechanism is in the locked state, the top cap is connected to the top of the central rod;

when the canopy is in the folded state, the top cap is disengaged from the central rod.

As another optional technical solution, the top cap is provided with a top cover at the top, and the top cap is provided with an internal capacitive cavity, and if the locking mechanism is in the locked state, the top of the central rod extends into the capacitive cavity and is located below the top cover.

As an optional third technical solution, the top cap is attached to the central rod and slidable along the central rod, if the locking mechanism is in the locked state, the top cap is locked at the lower portion of the central rod;

when folding the canopy, the top cap slides toward the upper portion of the central rod;

when the canopy is in the folded state, the top cap is located on the upper portion of the central rod.

Further, the central rod is provided with a top cover at the top, and the top cover is located above the top cap, and if the canopy is in the folded state, the top cap is abutted against the top cover.

Further, the central rod comprises a lower rod and an upper rod, the upper portion of the lower rod and the lower portion of the upper rod are slidably connected, and the bottom cap is connected to the lower portion of the lower rod.

Specifically, the operation part is located at the bottom cap or the bottom of the central rod.

Specifically, the peripheral assembly comprises a plurality of support legs, a plurality of outer retractable units connected between two adjacent support legs, each of the support legs is slidably provided with a sliding sleeve, each of the outer retractable units comprises at least two cross-bar groups connected in sequence, each of the cross-bar groups comprises two eaves rods arranged crosswise and hinged to each other, each of two end portions of each outer retractable unit have two connection points, one of the two connection points on each end portion of the outer retractable unit is rotatably connected to the top of the corresponding support leg, and the other is rotatably connected to the sliding sleeve;

each of the inner retractable units comprises at least two inner rod groups connected in sequence, each of the inner rod groups comprises a first top rod and a second top rod, the outer end portion of each inner retractable unit has two connection points, one of the two connection points on the outer end portion of each inner retractable unit is rotatably connected to the top of the corresponding support leg, and the other is rotatably connected to the sliding sleeve.

Further, the locking mechanism comprises a first locking member arranged on the central rod and a second locking member arranged on the top cap that is matched with the first locking member; if the locking mechanism is in the locked state, the relative position of the first locking member and the second locking member are fixed; if the locking mechanism is in the unlocked state, the fixed relative position of the first locking member and the second locking member can be released.

Based on any of the above technical solutions, the present disclosure provides a technical solution for a locking mechanism in a magnetic absorption manner: the first locking member is a first magnetic element disposed on the central rod, and the second locking member is a second magnetic element disposed on the top cap; if the locking mechanism is in the locked state, the first magnetic element is magnetically connected to the second magnetic element; if the locking mechanism is in the unlocked state, the first magnetic element is separated from the second magnetic element.

Further, the first magnetic element is disposed on the top of the central rod; the second magnetic element is disposed on the upper portion of the top cap, the top cap is provided with an internal cavity, and when the locking mechanism is in the locked state, the central rod is located at least partially in the cavity, and the second magnetic element is magnetically connected to the first magnetic element.

Specifically, the central rod comprises a lower rod and an upper rod, the upper portion of the lower rod and the lower portion of the upper rod are slidably connected, the first magnetic element is arranged on the upper portion of the lower rod, the second magnetic element is disposed on the upper portion of the top cap, the top cap is provided with an internal cavity, the top cap is slidably disposed with respect to the upper rod, and when the locking mechanism is in the locked state, the upper end of the upper rod is adjacent to the upper end of the lower rod, and the lower rod is located at least partially in the cavity, and the second magnetic element is magnetically connected to the first magnetic element; when the canopy is in the folded state, the upper end of the upper rod is away from the upper end of the lower rod.

Based on any of the above-mentioned technical solutions, the present disclosure provides a technical solution for a locking mechanism in a clamping manner, and the locking mechanism comprises:

a first clamping portion, disposed on the central rod;

a second clamping portion, disposed on the top cap, if the locking mechanism is in the locked state, the first clamping portion is clamped to the second clamping portion; if the locking mechanism is in the unlocked state, the first clamping portion is separated from the second clamping portion.

Specifically, the central rod is provided with a protrusion, and the protrusion is configured with a plug-in portion protruding upward, the first clamping portion protrudes outward from the outer wall of the plug-in portion, and the top cap is provided with an extension portion protruding downward, a gap is provided between the extension portion and the central rod, the gap forms an insert slot, the second clamping portion is a slot disposed on the inner wall of the insert slot, and when the locking mechanism is in the locked state, the plug-in portion is inserted into the insert slot, and the first clamping portion and the second clamping portion are clamped and connected to each other through the elasticity of the material itself.

Based on any of the above-mentioned technical solutions, the present disclosure provides a technical solution for a locking mechanism in a helical locking manner:

The central rod and the bottom cap are rotatably connected, and the locking mechanism comprises a protruding portion fixedly arranged on the central rod, a helical groove arranged on the top cap, a limiting groove connected with a terminal end of the helical groove, and an elastic element arranged between the bottom cap and the central rod; under the action of external force, the protruding portion can move from an initiating end to the terminal end of the helical groove and abut into the limiting groove; under the action of external force, the elastic piece can exert force on the central rod so that the protruding portion has a tendency to disengage from the limiting groove and move from the terminal end to the initiating end of the helical groove.

Further, the central rod is further provided with a stopper block, the stopper block is located below the protruding portion, and the stopper block is configured to limit the position of the top cap.

Further, two protruding portions are provided and symmetrically arranged on both sides of the central rod, and two helical grooves are provided one-to-one corresponding to the two protruding portions.

By adopting the above-mentioned technical solutions, in the collapsible canopy of the present disclosure, the locking mechanism is arranged between the top cap and the central rod, which can simplify the structure of the locking mechanism and save costs; in addition, the central rod has a length that is not limited by a canopy folding structure any more, and can be extended upwardly to raise the tarpaulin. At the same time, when performing the unlocking operation, the operation part is at the bottom of the entire central lock, and the operator does not need to pass his/her hand through the inner retractable units to operate, which is more convenient and labor-saving.

BRIEF DESCRIPTION

Some of the embodiments will be described in detail, with references to the following Figures, wherein like designations denote like members, wherein.

Reference Numbers in the Figures are

1-support leg; 11-sliding sleeve; 2-inner retractable unit; 21-first top rod; 22-second top rod; 3-central lock; 31-bottom cap; 32-central rod; 32*a*-lower rod; 32*b*-upper rod; 321-first magnetic element; 322-first clamping portion; 323-protruding portion; 324-protrusion; 325-plug-in portion; 326-stopper block; 33-top cap; 331-second magnetic element; 332-second clamping portion; 333-helical groove; 334-first capacitive slot; 335-second capacitive slot; 336-insert slot; 337-extension portion; 34-top cover; 35-elastic element; 4-outer retractable unit; 41-eaves rod.

DETAILED DESCRIPTION

In the following, the technical solutions of the present disclosure are explained clearly and completely below in conjunction with the accompanying drawings, and apparently, the described embodiments are merely a part of the embodiments of the present disclosure, not all the embodiments. Based on the embodiments of the present disclosure, all other embodiments obtained by one of ordinary skill in the art without creative work fall within the protective scope of the present disclosure.

In the description of the present disclosure, it should be noted that the terms "upper", "lower", "inner" and "outer" are defined according to the normal usage habits of the canopy. Furthermore, the terms "first" and "second" are used for descriptive purposes only and should not be construed to indicate or imply relative importance.

In addition, the technical features involved in the different implementations of the present disclosure described below can be combined with each other as long as they do not conflict with each other.

Embodiment 1

Figure 1:
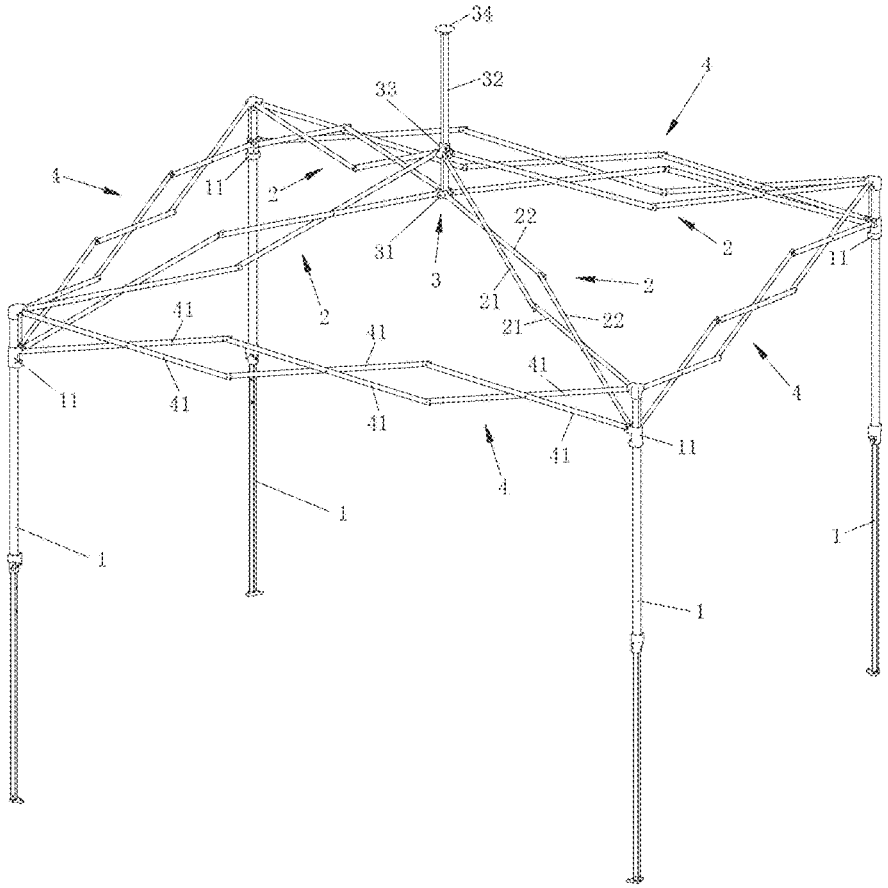
FIG. 1 is a schematic structural diagram of a collapsible canopy in the unfolded state according to an embodiment of the present disclosure, wherein the top of the central rod extends above the top cap, and the first top rod and the second top rod are X-shaped.
Figure 2:
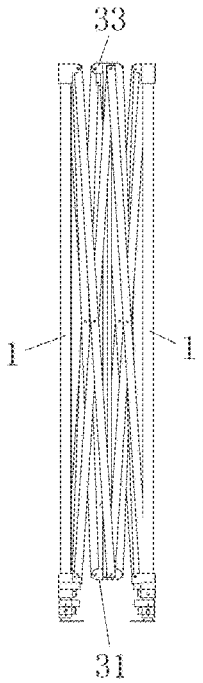
FIG. 2 is a schematic structural diagram of a collapsible canopy in the folded state in the embodiment shown in FIG. 1.

A collapsible canopy in this embodiment has an unfold state as shown in FIG. 1 and a folded state as shown in FIG. 2, referring specifically to FIG. 1, the collapsible canopy comprises a central lock 3, a peripheral assembly, and a plurality of inner retractable units 2 connected between the central lock 3 and the peripheral assembly. The peripheral assembly comprises a plurality of support legs 1, and a plurality of outer retractable units 4 connected between two adjacent support legs 1. The support legs 1 in this embodiment are of a retractable structure, so as to further reduce the size of the canopy in the up-down direction after being folded.

In the embodiment as shown in FIG. 1, the inner retractable units 2 are in one-to-one correspondence with the support legs 1, the inner end portion of each inner retractable unit 2 is connected to the central lock 3, and the outer end portion is connected with the corresponding support leg 1. Specifically, each inner retractable unit 2 comprises at least two inner rod groups connected in sequence, each of the inner rod groups comprises a first top rod 21 and a second top rod 22 hinged with each other, and in the embodiment as shown in FIG. 1, the middle part of the first top rod 21 and the middle part of the second top rod 22 are hinged to each other, so that the first top rod 21 and the second top rod 22 form an X shape. The specific connection mode of two adjacent inner rod groups is: the first top rod 21 in one inner rod group is hinged with the first top rod 21 in the other inner rod group, and the second top rod 22 in the one inner rod group is hinged with the second top rod 22 in the other inner rod group. The specific connection mode of each inner retractable unit 2 and the corresponding support leg 1 is: a sliding sleeve 11 is slidably arranged on the support leg 1, and the outer end portion of the inner retractable unit 2 has two connection points (that is, the outer end of the first top rod 21 and the outer end of the second top rod 22 in the outermost inner rod group of the inner retractable unit 2), one of the two connection points is rotatably connected to the top of the corresponding support leg 1, and the other is rotatably connected to the sliding sleeve 11. The specific connecting structure of each outer retractable unit 4 and the support legs 1 is: each of the outer retractable units 4 comprises at least two cross-bar groups connected in sequence, each of the cross-bar groups comprises two eaves rods 41 arranged crosswise and hinged to each other (forming an X shape), the two eaves rods 41 of a cross-bar group in the outer retractable unit 4 are in one-to-one correspondence and hinged with the two eaves rods 41 of the adjacent cross-bar group, the two ends of the outer retractable unit 4 correspond to different supporting legs 1 respectively, and each support leg 1 is connected with the end portions of two different outer retractable units 4 respectively, and the specific connection mode is as follows: each of the two end portions of each outer retractable unit 4 has two connection points, and for the two connection points of each end portion of each outer retractable unit 4, one is rotatably connected to the top of the corresponding support leg 1, and the other is rotatably connected to the sliding sleeve 11.

In another implementation, the number of the inner retractable units 2 is more than the number of the support legs 1, and except for the ones that are connected to the support legs 1 in a one-to-one correspondence in the plurality of inner retractable units 2, the outer end portions of the remaining inner retractable units 2 are connected to the outer retractable units 4.

The central lock 3 comprises a bottom cap 31, a central rod 32, a top cap 33, and a locking mechanism. The inner end portions of the above-mentioned second top rods 22 (the second top rods 22 in the innermost inner rod groups of the inner retractable units 2) are hinged with the bottom cap 31, and the above-mentioned first top rods 21 (the first top rods 21 in the innermost inner rod groups of the inner retractable units 2) are hinged with the top cap 33. The bottom cap 31 is connected to the lower portion of the central rod 32, and the top cap 33 is located right above the bottom cap 31 and can move relative to the central rod 32.

The locking mechanism is arranged between the top cap 33 and the central rod 32, and the locking mechanism has a locked state and an unlocked state; when the locking mechanism is in the locked state, the relative position between the top cap 33 and the central rod 32 is fixed, and the canopy is locked in the unfolded state, and when the locking mechanism is in the unlocked state, the fixed relative position between the top cap 33 and the central rod 32 is released, and the canopy can be folded or unfolded.

In one embodiment, an operation part for performing an unlocking or locking operation is further provided, and the position of the operation part is arranged at the bottom of the central rod 32 or at the bottom cap 31. The locking mechanism is unlocked or locked by operating the bottom cap 31 or the bottom of the central rod 32.

As shown in FIG. 1, the top cap 33 is attached to the central rod 32 and slidable along the central rod 32, and when the locking mechanism is in the locked state, the top cap 33 is located in the middle of the central rod 32, and the top of the central rod 32 extends above the top cap 33; at this time, when the canopy frame is covered with a tarpaulin, the upwardly protruding central rod 32 plays a role in raising the tarpaulin. When the locking mechanism is unlocked and the collapsible canopy is in the folded state, the top cap 33 slides upward along the central rod 32 to the top of the central rod 32 as the canopy is folded.

In an embodiment, the central rod 32 is provided with a top cover 34 at the top, and when the canopy is folded, the top cap 33 is located below the top cover 34 (optionally abuts against the bottom surface of the top cover 34). The top cover 34 plays a role in supporting the tarpaulin, preventing the central rod 32 from puncturing the tarpaulin, and in addition, when the canopy is unlocked, folded, unfolded, etc., the top cover 34 can be used as an operating component, which is convenient for the user to grab during the operation.

Embodiment 2

Figure 3:
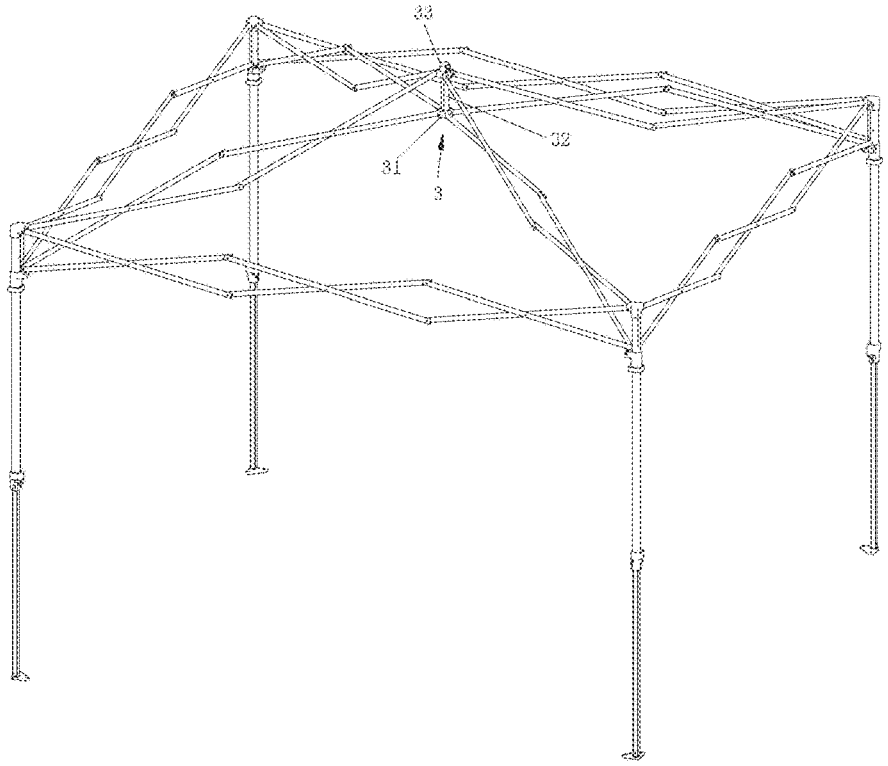
FIG. 3 is a schematic structural diagram of a collapsible canopy in the unfolded state according to another embodiment of the present disclosure, wherein the central rod does not extend above the top cap, and the first top rod and the second top rod are X-shaped.

Referring to FIG. 3, the collapsible canopy in this embodiment differs from Embodiment 1 in that the top cap 33 and the central rod 32 of the central lock 3 are detachably connected, that is, when the locking mechanism is in the locked state, the top cap 33 is connected to the top of the central rod 32, that is, the central rod 32 does not extend above the top cap 33; when the locking mechanism is unlocked and the collapsible canopy is in the folded state, the top cap 33 moves upward and is disengaged from the central rod 32 as the canopy is folded.

Further, the top cover 34 in this embodiment is arranged on the top of the top cap 33, and the top hat 33 has a first capacitive slot 334, and when the collapsible canopy is in the unfolded state and the locking mechanism is locked, the top of the central rod 32 protrudes into the first capacitive slot 334 of the top cap 33 and is located below the top cover 34 (optionally abuts against the bottom surface of the top cover 34), please refer to FIGS. 9 to 13 and FIGS. 18 to 29. The top cover 34 and the top cap 33 may be two fixedly connected components, or may be integrally formed.

Embodiment 3

The collapsible canopy in this embodiment differs from the above embodiments in that the top cap 33 and the central rod 32 of in the central lock 3 can be slidably and detachably connected to each other, that is, different from the way in which the top cap 33 is connected to the top of the central rod 32 in Embodiment 2, in this embodiment, the top cap 33 is connected to the middle and upper portion of the central rod 32 or a position close to the top thereof, and when the locking mechanism is in the locked state, the top cap 33 is located in the middle of the central rod 32, and the top of the central rod 32 extends above the top cap 33, and when the locking mechanism is in the unlocked state, the top cap 33 slides upward along the central rod 32 and finally is disengaged from the central rod 32 as the canopy is folded.

Embodiment 4

Figure 4:
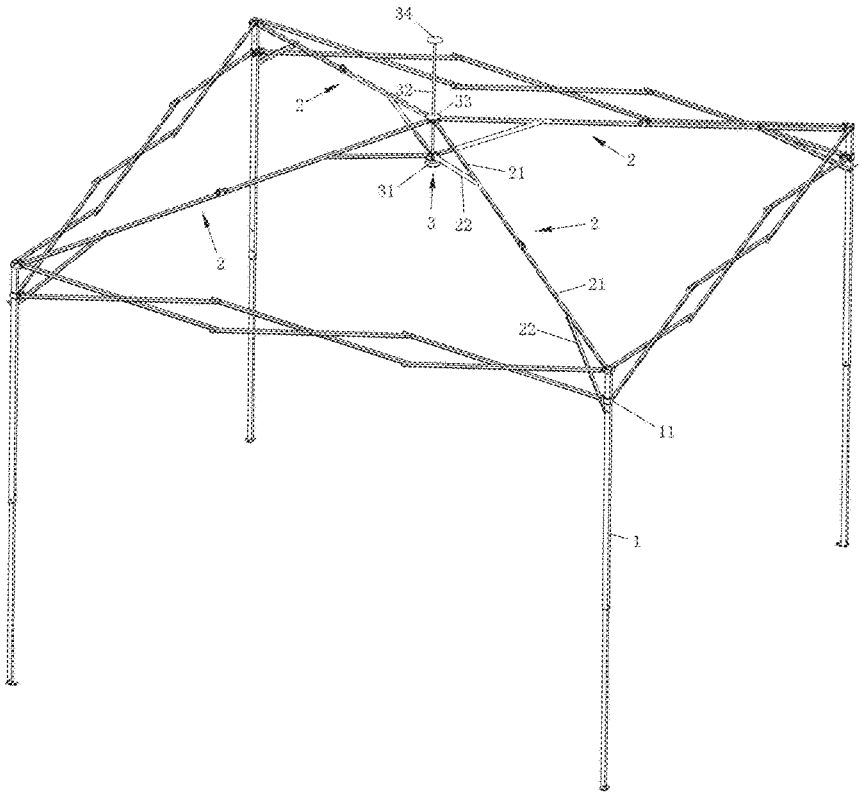
FIG. 4 is a schematic structural diagram of a collapsible canopy in the unfolded state according to yet another embodiment of the present disclosure, wherein the first top rod and the second top rod are Y-shaped.

Referring to FIG. 4, compared with Embodiment 1, the collapsible canopy in this embodiment is the same in that each inner retractable unit 2 comprises two first top rods 21 and two second top rods 22, the end portions of the two first top rods 21 are hinged with each other, and differs in that: the two second top rods 22 are respectively hinged at the positions of the corresponding first top rods 21 near the middle (or the middle), so as to form a "Y" shape at both ends of the inner retractable unit 2. In this embodiment, each inner retractable unit 2 has two inner rod groups, and in the inner rod group on the inner side, one end of the second top rod 22 is hinged with the bottom cap 31, and the other end is hinged with the middle portion of the first top rod 21; in the inner rod group on the outer side, one end of the second top rod 22 is hinged with the sliding sleeve 11, and the other end is hinged with the middle portion of the first top rod 21; the outer end portion of the first top rod 21 in the inner rod group on the inner side is hinged with the inner end portion of the first top rod 21 in the inner rod group on the outer side.

Compared with the X-shaped structure, the inner retractable unit 2 with the Y-shaped structure uses less rods and materials, and the overall canopy is lighter.

Embodiment 5

Figure 5:
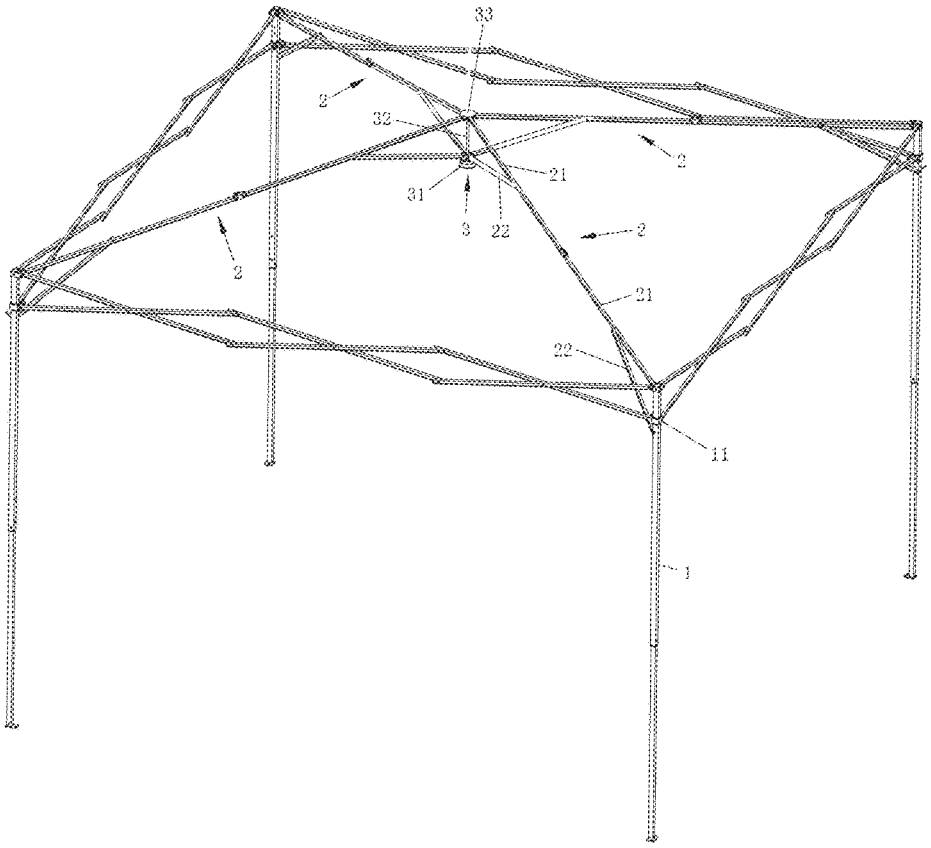
FIG. 5 is a schematic structural diagram of a collapsible canopy in the unfolded state according to yet another embodiment of the present disclosure, wherein the first top rod and the second top rod are Y-shaped.
Figure 6:
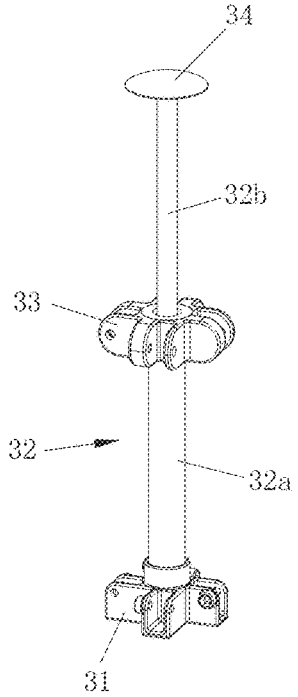
FIG. 6 is a schematic structural diagram of the central lock according to yet another embodiment of the present disclosure when the locking mechanism thereof is in the locked state, wherein the top of the central rod extends above the top cap.
Figure 7:
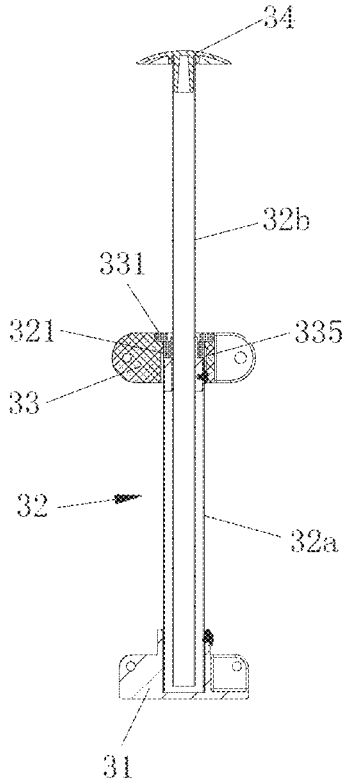
FIG. 7 is a schematic sectional structure diagram of the central lock shown in FIG. 6.
Figure 8:
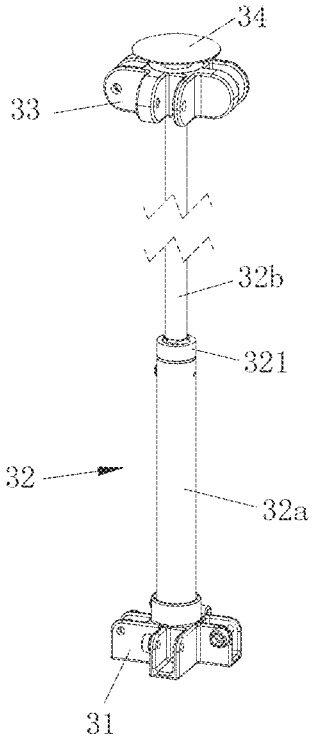
FIG. 8 is a schematic structural diagram of the central lock shown in FIG. 6 when the locking mechanism is in the unlocked state and the collapsible canopy is in the folded state.
Figure 9:
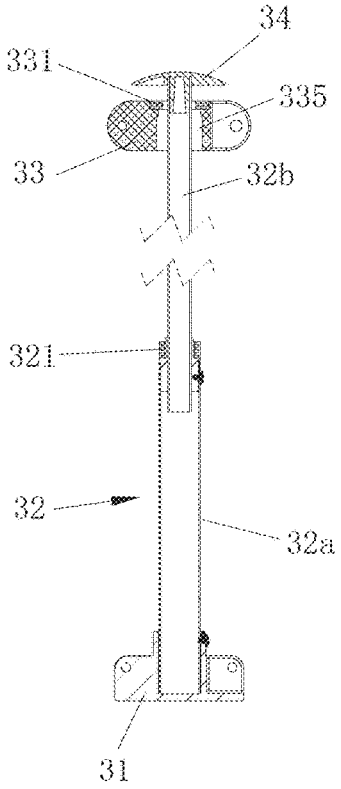
FIG. 9 is a schematic sectional structure diagram of the central lock shown in FIG. 8.
Figure 10:
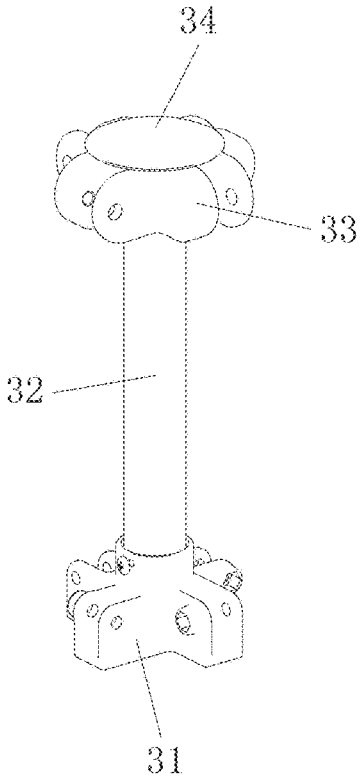
FIG. 10 is a schematic structural diagram of the central lock of the embodiment shown in FIG. 6 when the locking mechanism thereof is in the locked state, wherein the central rod does not extend above the top cap.
Figure 11:
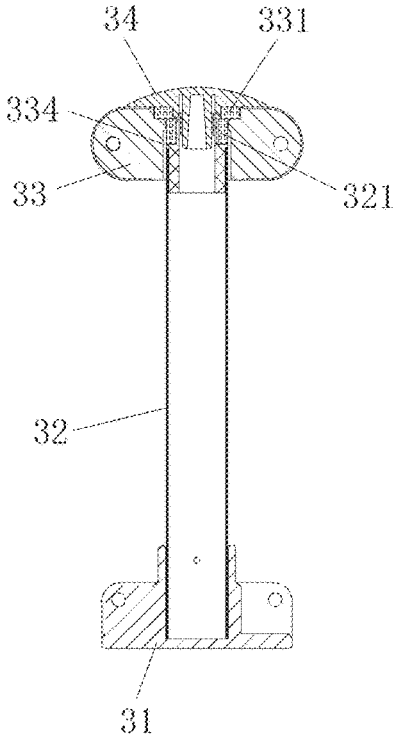
FIG. 11 is a schematic sectional structure diagram of the central lock shown in FIG. 10.
Figure 12:
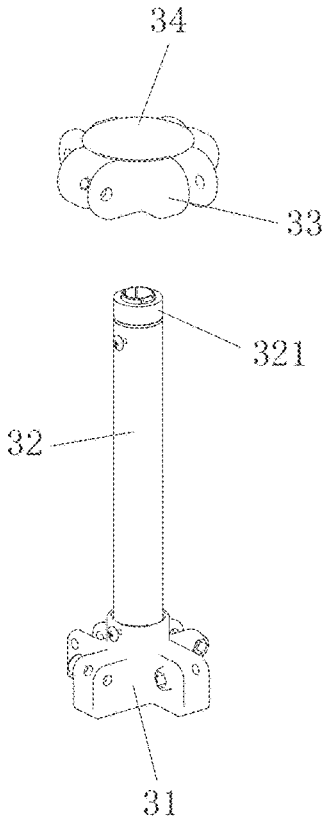
FIG. 12 is a schematic structural diagram of the central lock shown in FIG. 10 when the locking mechanism is in the unlocked state and the collapsible canopy is in the folded state.
Figure 13:
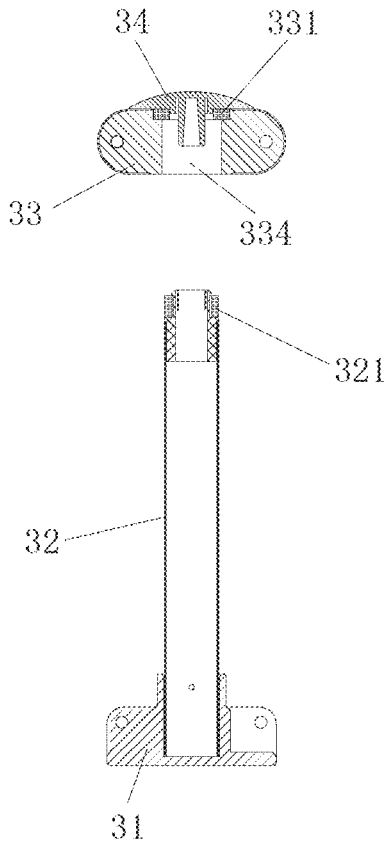
FIG. 13 is a schematic sectional structure diagram of the central lock shown in FIG. 12.
Figure 14:
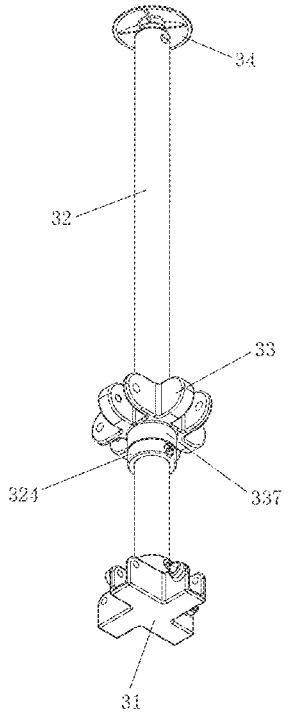
FIG. 14 is a schematic structural diagram of the central lock according to yet another embodiment of the present disclosure when the locking mechanism thereof is in the locked state, wherein the top of the central rod extends above the top cap.
Figure 15:
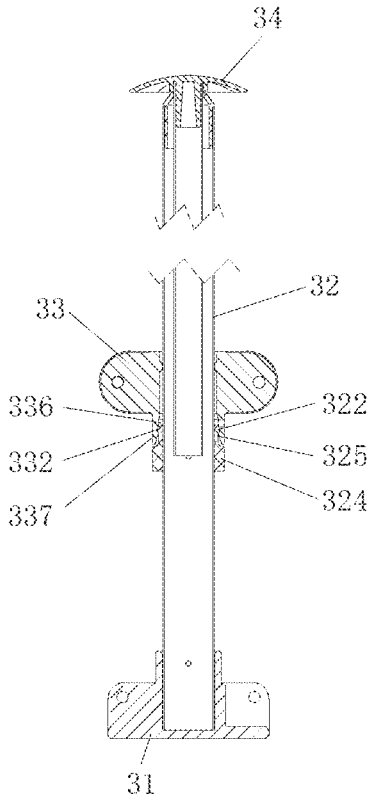
FIG. 15 is a schematic sectional structure diagram of the central lock shown in FIG. 14.
Figure 16:
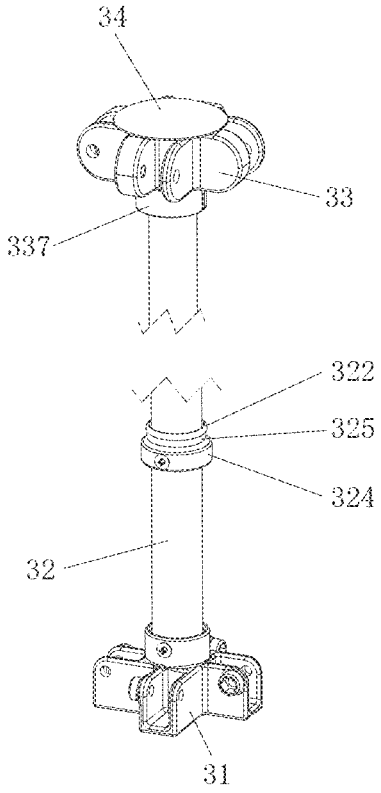
FIG. 16 is a schematic structural diagram of the central lock shown in FIG. 14 when the locking mechanism is in the unlocked state and the collapsible canopy is in the folded state.
Figure 17:
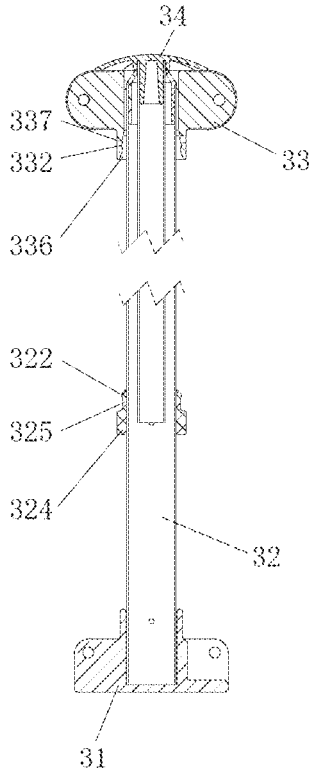
FIG. 17 is a schematic sectional structure diagram of the central lock shown in FIG. 16.
Figure 18:
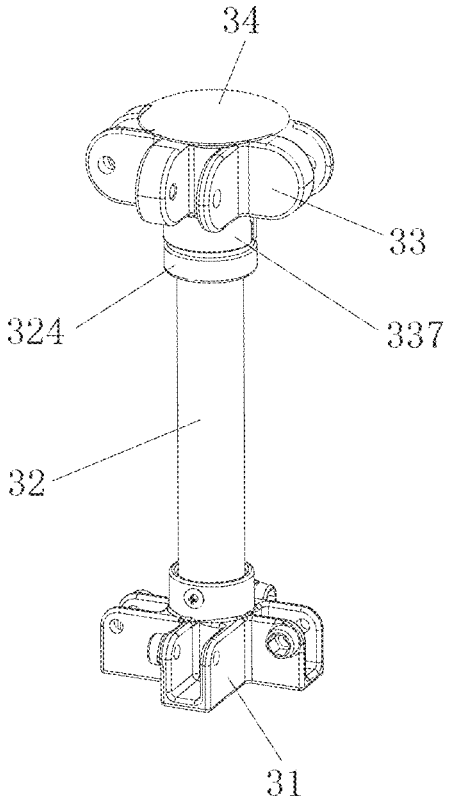
FIG. 18 is a schematic structural diagram of the central lock of the embodiment shown in FIG. 14 when the locking mechanism thereof is in the locked state, wherein the central rod does not extend above the top cap.
Figure 19:
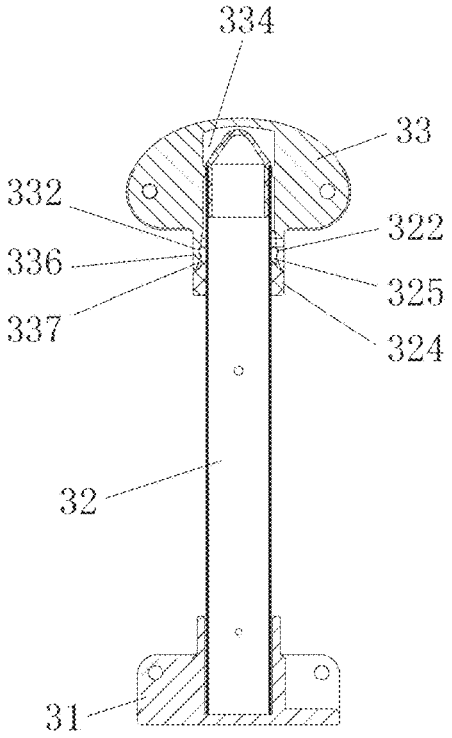
FIG. 19 is a schematic sectional structure diagram of the central lock shown in FIG. 18.
Figure 20:
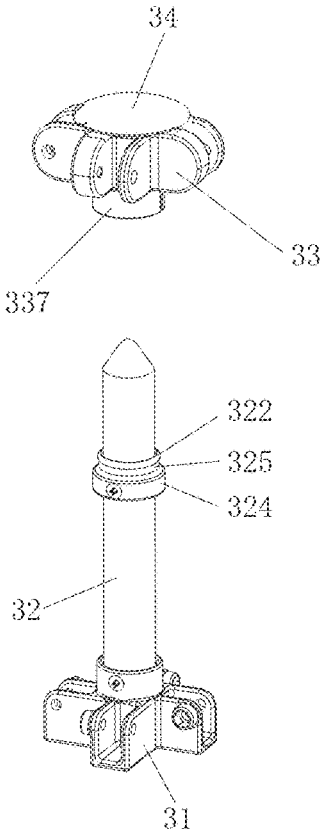
FIG. 20 is a schematic structural diagram of the central lock shown in FIG. 18 when the locking mechanism is in the unlocked state and the collapsible canopy is in the folded state.
Figure 21:
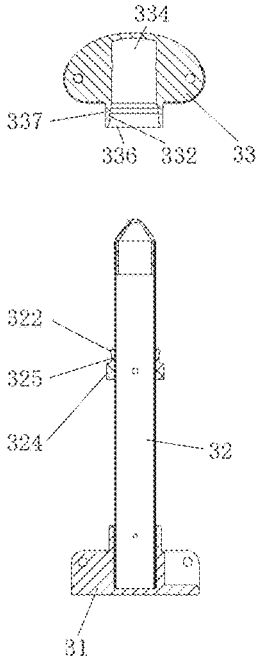
FIG. 21 is a schematic sectional structure diagram of the central lock shown in FIG. 20.
Figure 22:
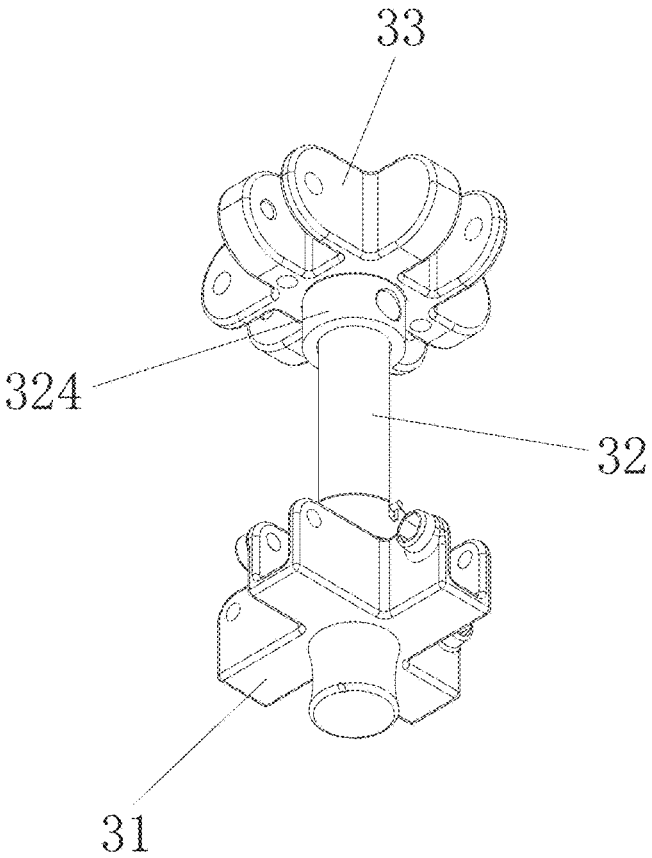
FIG. 22 is a schematic structural diagram of the central lock according to yet another embodiment of the present disclosure when the locking mechanism thereof is in the locked state, wherein the top of the central rod does not extend above the top cap.
Figure 23:
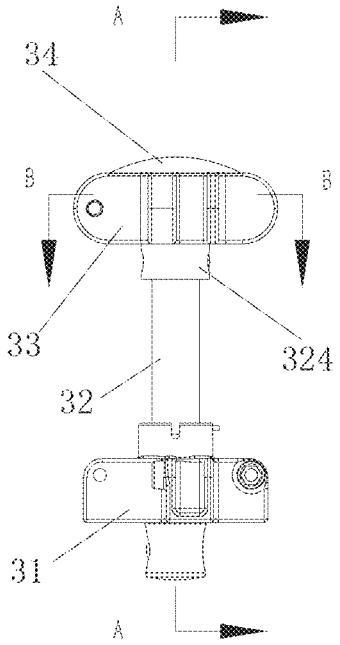
FIG. 23 is a schematic main structure diagram of the central lock shown in FIG. 22.
Figure 24:
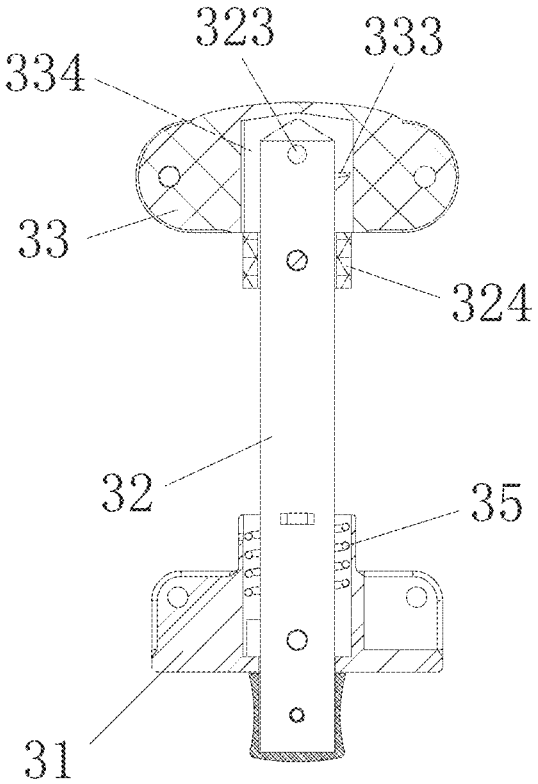
FIG. 24 is a schematic structure diagram of A-A section in FIG. 23.
Figure 25:
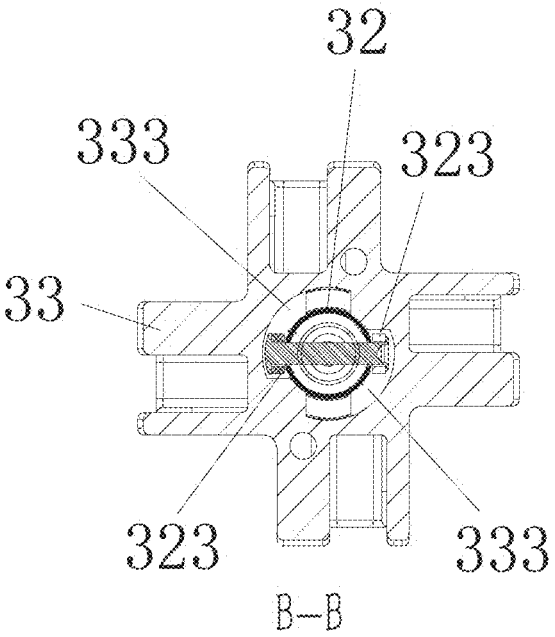
FIG. 25 is a schematic structure diagram of B-B section in FIG. 23.
Figure 26:
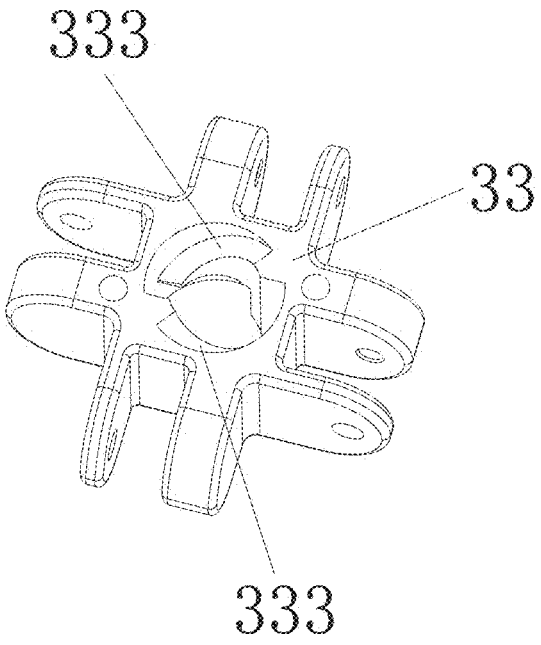
FIG. 26 is a schematic structure diagram of the top cap of the central lock shown in FIG. 22.
Figure 27:
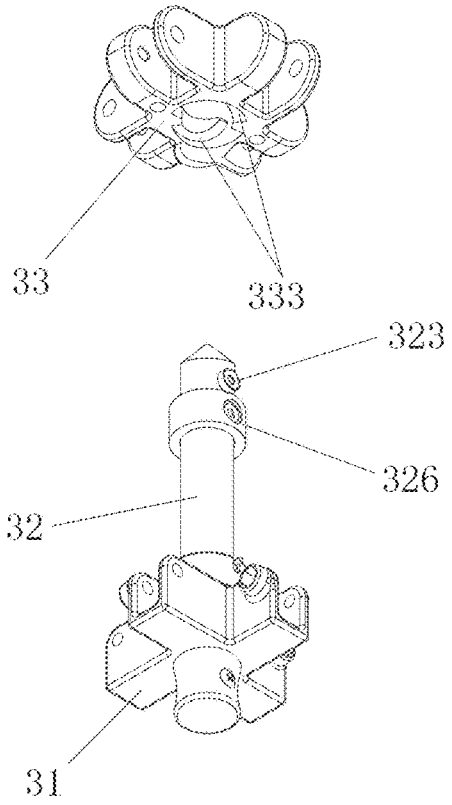
FIG. 27 is a schematic structural diagram of the central lock shown in FIG. 22 when the locking mechanism is in the unlocked state and the collapsible canopy is during the folding process.
Figure 28:
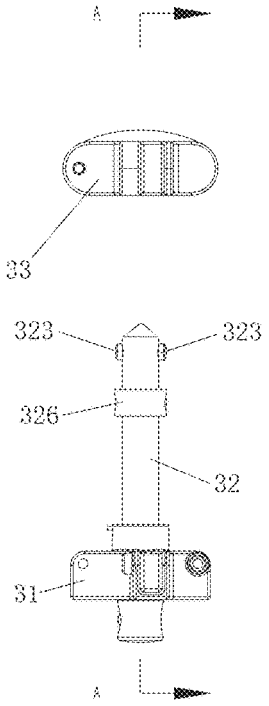
FIG. 28 is a schematic main structure diagram of the central lock shown in FIG. 27.
Figure 29:
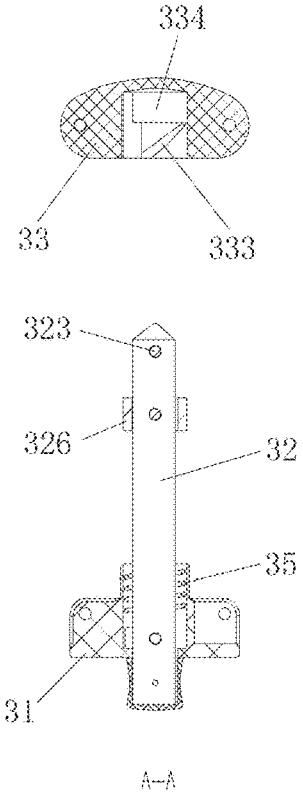
FIG. 29 is a schematic structure diagram of A-A section in FIG. 28.
Figure 30:
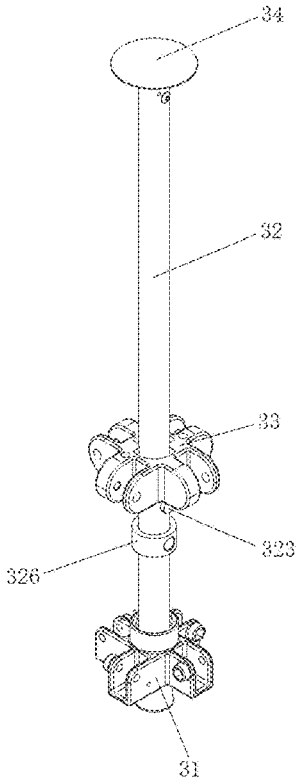
FIG. 30 is a schematic structural diagram of the central lock of the embodiment shown in FIG. 22 when the locking mechanism thereof is in the locked state, wherein the top of the central rod extends above the top cap.
Figure 31:
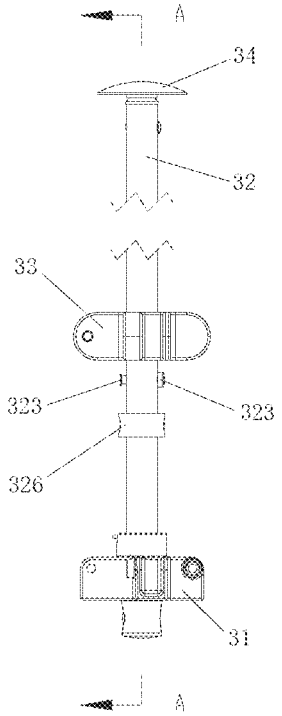
FIG. 31 is a schematic main structure diagram of the central lock shown in FIG. 30.
Figure 32:
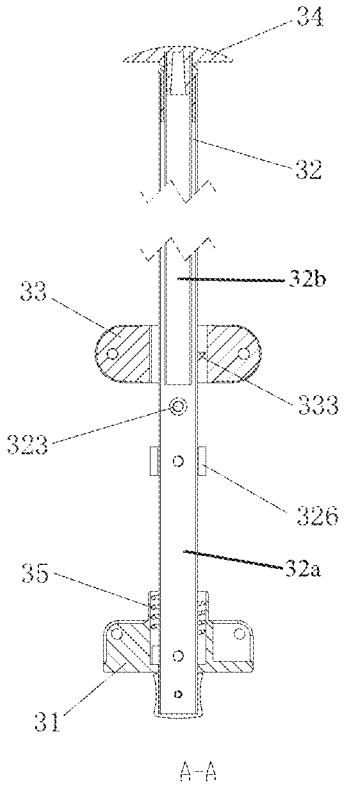
FIG. 32 is a schematic structure diagram of A-A section in FIG. 31.
Figure 33:
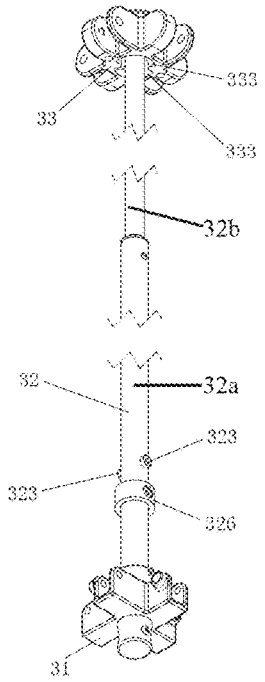
FIG. 33 is a schematic structural diagram of the central lock shown in FIG. 22 when the locking mechanism is in the unlocked state and the collapsible canopy is in the folded state.
Figure 34:
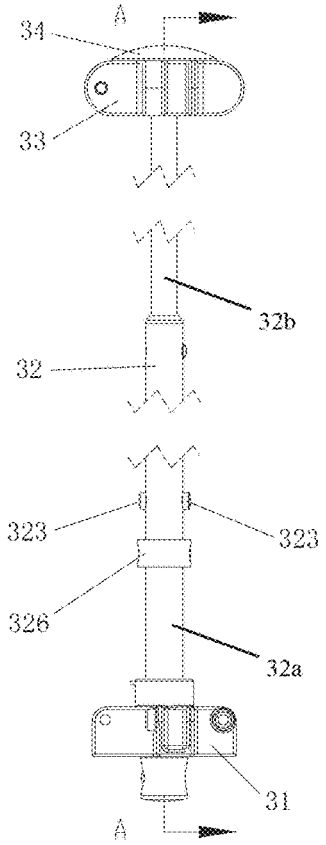
FIG. 34 is a schematic main structure diagram of the central lock shown in FIG. 33.
Figure 35:
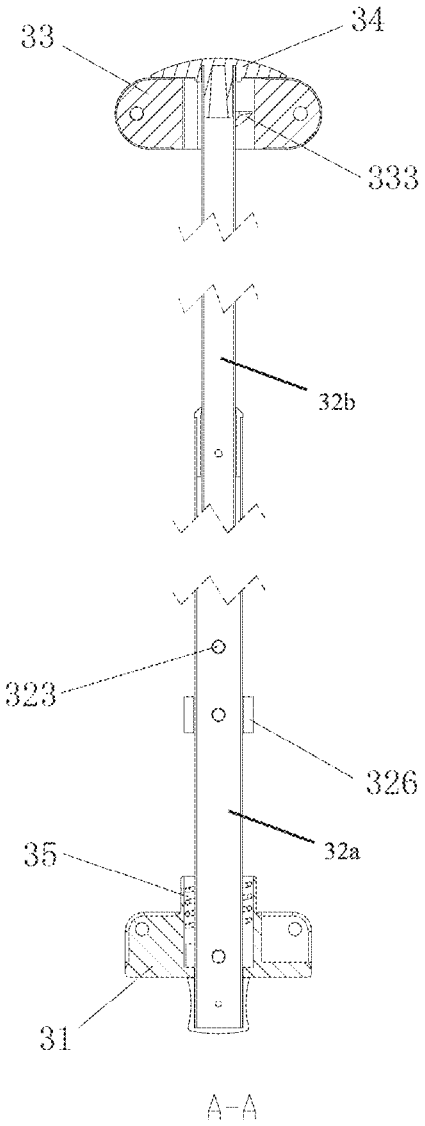
FIG. 35 is a schematic structure diagram of A-A section in FIG. 34.

Referring to FIG. 5, the collapsible canopy in this embodiment differs from Embodiment 2 mentioned above in that: the first top rod 21 and the second top rod 22 of each inner rod group of the inner retractable units 2 form a "Y" shape. In this embodiment, the specific structure of the inner retractable units 2 and their connection structure with the support legs 1 and the central lock 3 are basically the same as those in the above-mentioned Embodiment 4, and the description will not be repeated here.

Embodiment 6

Referring to FIG. 6 to FIG. 13, this embodiment provides a specific structure of a locking mechanism, and this structure is applicable to any of the collapsible canopies in the above-mentioned Embodiment 1 to Embodiment 5. Wherein, FIGS. 6 to 9 show the situation when the canopy is in the unfolded state, and the central rod 32 extends above the top cap 33;

FIGS. 10 to 13 show the situation when the canopy in the unfolded state, and the central rod 32 does not extend above the top cap 33.

In this embodiment, the central rod 32 and the bottom cap 31 are fixedly connected.

The locking mechanism comprises a first magnetic element 321 arranged on the central rod 32 and a second magnetic element 331 arranged on the top cap 33. When the locking mechanism is in the locked state, the first magnetic element 321 and the second magnetic element 331 are magnetically connected, and when the locking mechanism is in the unlocked state, the first magnetic element 321 and the second magnetic element 331 are separated from each other.

Specifically, in the case where the canopy is unfolded and the central rod 32 extends above the top cap 33 as shown in FIG. 6 to FIG. 9, the first magnetic element 321 is fixedly arranged on the middle portion of the central rod 32. Inan embodiment, as shown in FIG. 6 to FIG. 9, the central rod 32 comprises a lower rod 32*a* and an upper rod 32*b*, the lower portion of the lower rod 32*a* is connected to the bottom cap 31, and the bottom of the upper rod 32*b* is connected with the top of the lower rod 32*a*, wherein the lower rod 32*a* is relatively thicker, the upper rod 32*b* is relatively thinner, and the first magnetic element 321 is arranged on the top of the lower rod 32*a*. The top cap 33 is slidably connected to the upper rod 32*b*, the top cap 33 has a second capacitive slot 335, and when the canopy is unfolded and the locking mechanism is locked, the top cap 33 slides to the bottom of the upper rod 32*b*, and the top of the lower rod 32*a* is inserted into the second capacitive slot 335; through the arrangement of this structure, the lower rod 32*a* supports the top cap 33, so that the structure is more stable after the central lock is locked. In an alternative implementation, as in Embodiment 7 to be described below, the central rod 32 can be provided to have the same thickness up and down, and then a protrusion 324 is connected on the central rod 32 to replace the supporting function of the lower rod 32*a* for the top cap 33, the first magnetic element 321 is arranged on the protrusion 324 (No specific drawings are given, and the present structure can be understood with reference to FIGS. 18 to 21); when locked, the top cap 33 slides along the central rod 32 to the position of the protrusion 324, and the protrusion 324 supports the top cap 33.

The above-mentioned lower rod 32*a* and upper rod 32*b* may be fixedly or slidably connected, specifically, the lower rod 32*a* has a cavity, and the upper rod 32*b* is telescopically inserted therewith. The slidable connection structure between the lower rod 32*a* and the upper rod 32*b* makes the overall length of the central rod 32 adjustable, and when the canopy is unfolded, the upper rod 32*b* slides to a suitable position relative to the lower rod 32*a*, for example, the lower portion of the upper rod 32*b* abuts against the lower rod 32*a*, so that the tarpaulin of the canopy is lifted to a suitable height, and when the canopy is folded, the top cap 33 slides to abut against the bottom surface of the top cover 34, and then pushes the upper rod 32*b* away from the lower rod 32*a*, so as to meet the requirement of the first top rod 21 and the second top rod 22 for the distance with the connection point of the central lock during the folding process. In particular, the overall length of the central rod 32 is substantially the same as the length of the shortened support legs 1, so that the folded canopy structure is more compact.

Specifically, in the case where the canopy is unfolded and the central rod 32 does not extend above the top cap 33 as shown in FIG. 10 to FIG. 13, the first magnetic element 321 is fixedly arranged on the top of the central rod 32. When the locking mechanism is locked, the top of the central rod 32 is inserted into the first capacitive slot 334 of the top cap 33, and the first magnetic element 321 and the second magnetic element 331 attract each other.

In an embodiment, both the first magnetic element 321 and the second magnetic element 331 are annular, so that there is a relatively larger contact area and attractive force of magnetic connection therebetween.

In an embodiment, in the above two cases, the second magnetic element 331 is arranged on the upper portion of the top cap 33; when the first magnetic element 321 and the second magnetic element 331 attract each other, the second magnetic element 331 is above the first magnetic element 321, and the up-down structural arrangement can make the connection between the two more stable and prevent the two from being disengaged.

In the locking mechanism in this embodiment, when the canopy is unfolded, after the top cap 33 slides to the corresponding position, the first magnetic element 321 and the second magnetic element 331 can be automatically attracted and connected to each other, and when unlocking is required, it is only necessary to forcefully overcome the attractive force of the magnetic connection between the first magnetic element 321 and the second magnetic element 331 to separate the two to achieve unlocking.

Embodiment 7

Referring to FIG. 14 to FIG. 21, this embodiment provides a specific structure of a locking mechanism, and this structure is applicable to any of the collapsible canopies in the above-mentioned Embodiment 1 to Embodiment 5. Wherein, FIGS. 14 to 17 show the situation when the canopy is in the unfolded state, and the central rod 32 extends above the top cap 33;

FIGS. 18 to 21 show the situation when the canopy in the unfolded state, and the central rod 32 does not extend above the top cap 33.

In this embodiment, the central rod 32 and the bottom cap 31 are fixedly connected.

The locking mechanism in this embodiment comprises a first clamping portion 322 arranged on the central rod 32 and a second clamping portion 332 arranged on the top cap 33, and when the locking mechanism is in the locked state, the first clamping portion 322 is clamped with the second clamping portion 332, and when the locking mechanism is in the unlocked state, the first clamping portion 322 and the second clamping portion 332 are separated.

Specifically, in the above two cases (the canopy is unfolded with the case of the central rod 32 extending above the top cap 33 and the case of the central rod 32 not extending above the top cap 33), the central rod 32 is provided with a protrusion 324, the protrusion 324 is annular, and the protrusion 324 is provided with a plug-in portion 325 protruding upward; the first clamping portion 322 protrudes outward from the outer wall of the plug-in portion 325, and the top cap 33 has an extension portion 337 protruding downward, there is a gap between the extension portion 337 and the central rod 32, the gap forms an insert slot 336, and the second clamping portion 332 is a slot disposed on the inner wall of the insert slot 336; when the canopy is unfolded, as the top cap 33 and the central rod 32 slide with respect to each other, the plug-in portion 325 is inserted into the insert slot 336 of the top cap 33, the first clamping portion 322 and the second clamping portion 332 are clamped and connected to each other through the elasticity of the material itself, and at the same time, the protrusion 324 supports the top cap 33.

In the locking mechanism in this embodiment, when the canopy is unfolded, after the top cap 33 slides to the corresponding position, the first clamping portion 322 and the second clamping portion 332 can be clamped tightly through the elasticity of the material itself, and when unlocking is required, the unlocking can be achieved by forcefully separating the first clamping portion 322 from the second clamping portion 332.

Embodiment 8

Referring to FIG. 22 to FIG. 35, this embodiment provides a specific structure of a locking mechanism, and this structure is applicable to any of the collapsible canopies in the above-mentioned Embodiment 1 to Embodiment 5. Wherein, FIGS. 22 to 29 show the situation when the canopy is in the unfolded state, the central rod 32 does not extend above the top cap 33;

FIGS. 30 to 35 show the situation when the canopy in the unfolded state, the central rod 32 extends above the top cap 33.

In this embodiment, the central rod 32 and the bottom cap 31 are rotatably (such as pivotally) connected. Besides sliding relative to each other, the central rod 32 and the top cap 33 can also rotate (such as pivot) relative to each other.

The locking mechanism comprises a protruding portion 323 arranged on the central rod 32 and a helical groove 333 arranged on the top cap 33. In an embodiment, there are two protruding portions 323 symmetrically arranged on both sides of the central rod 32, and correspondingly, there are also two symmetrically arranged helical grooves 333. Specifically, the protruding portions 323 may be a pin connected to the central rod 32, more specifically, the pin is fixedly inserted on the central rod 32 and two ends of the pin protrude from the central rod 32 to form two symmetrical protruding portions 323. Each helical groove 333 has an initiating end and a terminal end, and a limiting groove matched with a protruding portion 323 is provided at the terminal end. The locking mechanism further comprises an elastic element 35 arranged between the bottom cap 31 and the central rod 32, and the elastic element 35 is a torsion spring, and in the above two cases (the canopy is unfolded with the case of the central rod 32 extending above the top cap 33 and the case of the central rod 32 not extending above the top cap 33), the central rod 32 is manually rotated to switch the locking mechanism to the locked state, and during the process of switching to the locked state, the protruding portions 323 are rotated from the initiating ends of the helical grooves 333 to the terminal ends of the helical grooves 333, and at this time, the torsion spring is in a deformed state, so after the external force is removed, the protruding portions 323 rotate back into the limiting grooves and abut against the groove walls of the limiting grooves, and when the protruding portions 323 are clamped in the limiting grooves, the torsion spring is restored to the natural state (the second choice is to restore to a near-natural state); when it needs to convert the locking mechanism from the locked state to the unlocked state, the rotatable operation part on the bottom cap 31 is manually operated, and the rotatable operation part can drive the torsion spring to rotate, and then the torsion spring exerts a force on the central rod 32 to make the protruding portions 323 disengage from the limiting grooves and move from the terminal ends of the helical grooves 333 to the initiating ends, and finally exit the helical grooves 333.

Inan embodiment, the central rod 32 is further provided with a stopper block 326, the stopper block 326 is annular, and the stopper block 326 is located below the protruding portions 323, and when the locking mechanism is locked, the stopper block 326 support the top cap 33 to relieve the force of the protruding portions 323.

Further referring to FIGS. 32-35, the central rod 32 comprises a lower rod 32*a* and an upper rod 32*b*, the upper portion of the lower rod 32*a* and the lower portion of the upper rod 32*b* are slidably connected, and the protruding portions 323 and the stopper block 326 are disposed on the lower rod 32*a*, and the top cap 33 is slidably connected with respect to the upper rod 32*b*.

In the locking mechanism in this embodiment, when the canopy is unfolded, after the top cap 33 slides to the corresponding position, the protruding portions 323 on the central rod 32 correspond to the positions of the corresponding helical grooves 333 and enter from the shallow ends of the helical grooves 333. When the protruding portions 323 slide in depth along the helical grooves 333, under the interaction between the helical grooves 333 and the protruding portions 323, the central rod 32 is rotated relative to the top cap 33 and the bottom cap 31, and under the action of the elastic element 35, the protruding portions 323 will press against the limiting grooves at the terminal ends in the helical grooves 333 and will not come out. When unlocking is required, the rotatable operation part on the bottom cap 31 is rotated to rotate the elastic element 35 to drive the central rod 32 to rotate, the rotation direction of the central rod 32 during the unlocking operation is opposite to the rotation direction during the locking operation, so that the protruding portions 323 exit the helical grooves 333, that is, the unlocking is realized.

Embodiment 9

Figure 36:
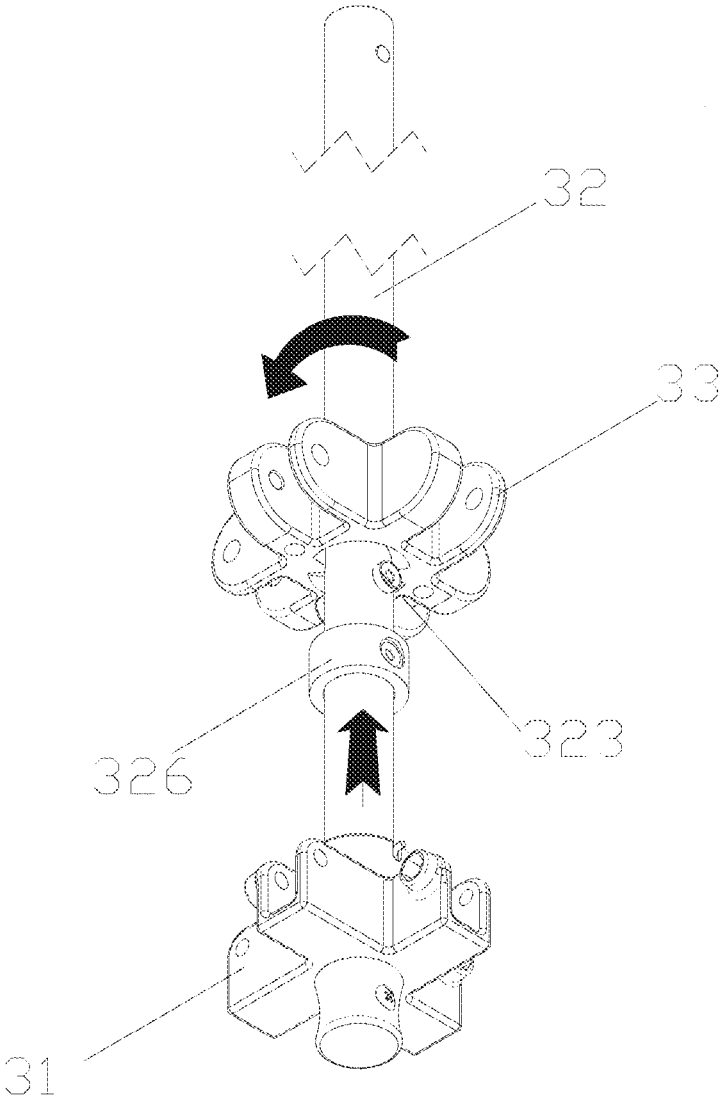
FIG. 36 is a schematic diagram of the state in which the top cap is to be locked at the lower portion of the central rod in yet another embodiment of the present disclosure.
Figure 37:
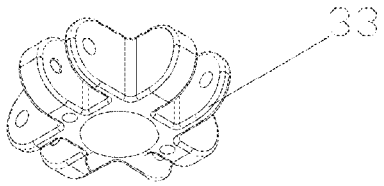
FIG. 37 is a schematic diagram of the separation state of the top cap from the central rod when the top cap in FIG. 36 is unlocked and the canopy is in the folded state, wherein the first top rod connected with the top cap is omitted.
Figure 37:
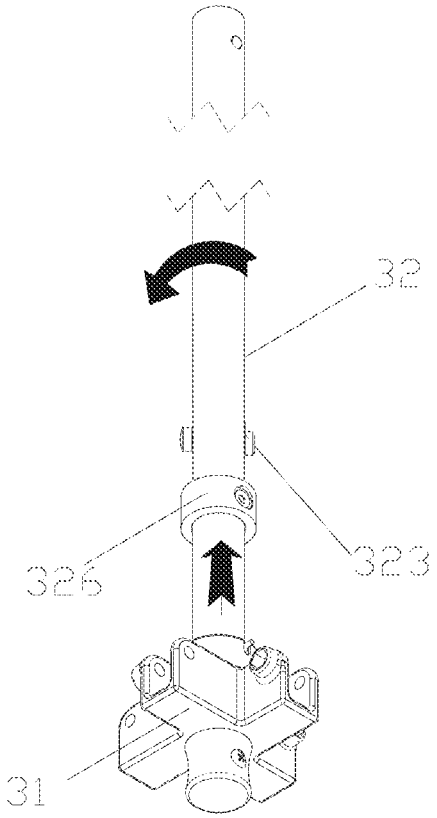

Referring to FIGS. 36-37, in this embodiment, the top cap 33 of the collapsible canopy is attached to the central rod 32 and slidable along the central rod 32, and if the locking mechanism is in the locked state, the top cap 33 is locked at the lower portion of the central rod 32; when folding the canopy, the top cap 33 is slided toward the upper portion of the central rod 32; when the canopy is in the folded state, the top cap 33 and the central rod 32 are disengaged from each other.

This embodiment mainly defines that the locking position locates at the lower portion of the central rod 32, and the top of the central rod 32 is not configured with the top cover 34 as described in the some previous embodiments, and then when the canopy is in the folded state, the top cap 33 moves upward and finally disengages from the central rod 32. Therefore, it can optionally be combined with the specific implementations of the locking mechanisms in the above-mentioned Embodiments 1 to 8, for example, the locking mechanism comprising the first magnetic element 321 and the second magnetic element 331 in Embodiment 6, for another example, the locking mechanism comprising the first clamping portion 322 and the second clamping portion 332 in Embodiment 7, for yet another example, the locking mechanism comprising the protruding portion 323 and the helical groove 333 in Embodiment 8.

It should be noted that the protruding portion 323 and the stopper block 326 on the central rod 32 shown in FIGS. 36 and 37 are only examples for combining with the locking mechanism of Embodiment 8, and are not specific limitations of the locking mechanism in this embodiment.

In the collapsible canopies in the above mentioned embodiments, by arranging the locking mechanism between the top cap and the central rod, it can simplify the structure of the locking mechanism and save costs; in addition, the central rod has a length that is not limited by a canopy folding structure any more, and can be extended upwardly to raise the tarpaulin. At the same time, when performing the unlocking operation, the operation part is at the bottom of the entire central lock, and the operator does not need to pass his/her hand through the inner retractable units to operate, which is more convenient and labor-saving.

Although the present invention has been disclosed in the form of embodiments and variations thereon, it will be understood that numerous additional modifications and variations could be made thereto without departing from the scope of the invention.

For the sake of clarity, it is to be understood that the use of 'a' or 'an' throughout this application does not exclude a plurality, and 'comprising' does not exclude other steps or elements.

The claims are as follows:

1. A collapsible canopy, comprising a central lock, a peripheral assembly, and a plurality of inner retractable units connected between the central lock and the peripheral assembly, each inner retractable unit comprising a first top rod and a second top rod hinged to each other, wherein the central lock comprises:

a bottom cap, hinged with the second top rod;

a central rod, wherein a lower portion of the central rod is connected to the bottom cap;

a top cap, arranged above the bottom cap, and hinged with the first top rod;

a locking mechanism, arranged between the top cap and the central rod, and provided with a locked state and an unlocked state; and an operation part for a user to operate to lock and/or unlock the locking mechanism, the operation part located at the bottom of the central lock;

wherein the locking mechanism comprises a first locking member arranged on the central rod and a second locking member arranged on the top cap that is matched with the first locking member;

wherein, when the locking mechanism is in the locked state, a relative position between the top cap and the central rod is fixed, and a relative position of the first locking member and the second locking member is fixed;

wherein, when the locking mechanism is in the unlocked state, the relative position between the top cap and the central rod can be released, and the relative position of the first locking member and the second locking member can be released;

wherein the central rod and the bottom cap are rotatably connected, the first locking member is a protruding portion fixedly arranged on the central rod, and the second locking member comprises a helical groove arranged on the top cap and a limiting groove connected with a terminal end of the helical groove;

the bottom cap and the central rod are configured with an elastic element therebetween; under the action of external force, the protruding portion can move from an initiating end to the terminal end of the helical groove and abut into the limiting groove; under the action of external force, the elastic piece can exert force on the central rod so that the protruding portion has a tendency to disengage from the limiting groove and move from the terminal end to the initiating end of the helical groove.

2. The collapsible canopy according to claim 1, wherein the top cap is attached to the central rod and slidable along the central rod, when the locking mechanism is in the locked state, the top cap is locked at the lower portion of the central rod;

when folding the collapsible canopy, the top cap slides toward an upper portion of the central rod;

when the canopy is in the folded state, the top cap is located on the upper portion of the central rod.

3. The collapsible canopy according to claim 2, wherein the central rod is provided with a top cover at the top, and the top cover is located above the top cap; when the canopy is in the folded state, the top cap is abutted against the top cover.

4. The collapsible canopy according to claim 2, wherein the central rod comprises a lower rod and an upper rod, the upper portion of the lower rod and the lower portion of the upper rod are slidably connected, and the bottom cap is connected to the lower portion of the lower rod.

5. The collapsible canopy according to claim 1, wherein the operation part is located at the bottom cap or the bottom of the central rod.

6. The collapsible canopy according to claim 1, wherein the peripheral assembly comprises a plurality of support legs, a plurality of outer retractable units connected between two adjacent support legs; each of the support legs is provided with a sliding sleeve; each of the outer retractable units comprises at least two cross-bar groups connected in sequence; each of the cross-bar groups comprises two eaves rods arranged crosswise and hinged to each other; each of two end portions of each outer retractable unit have two connection points, one of the two connection points on each end portion of the outer retractable unit is rotatably connected to the top of the corresponding support leg, and the other is rotatably connected to the sliding sleeve;

each of the inner retractable units comprises at least two inner rod groups connected in sequence; each of the inner rod groups comprises a first top rod and a second top rod; the outer end portion of each inner retractable unit has two connection points, one of the two connection points on the outer end portion of each inner retractable unit is rotatably connected to the top of the corresponding support leg, and the other is rotatably connected to the sliding sleeve.

7. The collapsible canopy according to claim 1, wherein the central rod is further provided with a stopper block, the stopper block is located below the protruding portion, and the stopper block is configured to limit the position of the top cap.

8. The collapsible canopy according to claim 1, wherein two protruding portions are provided and symmetrically arranged on both sides of the central rod, and two helical grooves are provided one-to-one corresponding to the two protruding portions.

9. The collapsible canopy according to claim 1, comprising:

when the locking mechanism is in the locked state, the top cap is connected to the top of the central rod;

when the canopy is in the folded state, the top cap is disengaged from the central rod.

10. The collapsible canopy according to claim 1, wherein the top cap is provided with a top cover at the top, and the top cap is provided with an internal capacitive cavity, and when the locking mechanism is in the locked state, the top of the central rod extends into the capacitive cavity and is located below the top cover.

* * * * *